US010629362B2

(12) United States Patent
Jung et al.

(10) Patent No.: US 10,629,362 B2
(45) Date of Patent: Apr. 21, 2020

(54) COIL COMPONENT AND METHOD FOR MANUFACTURING THE SAME

(71) Applicant: SAMSUNG ELECTRO-MECHANICS CO., LTD., Suwon-si, Gyeonggi-do (KR)

(72) Inventors: Jung Hyuk Jung, Suwon-si (KR); Sung Hee Kim, Suwon-si (KR); Hye Yeon Cha, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 98 days.

(21) Appl. No.: 15/786,138

(22) Filed: Oct. 17, 2017

(65) Prior Publication Data

US 2018/0211762 A1 Jul. 26, 2018

(30) Foreign Application Priority Data

Jan. 23, 2017 (KR) ..... 10-2017-0010480

(51) Int. Cl.

| | |
|---|---|
| ***H01F 27/28*** | (2006.01) |
| ***H01F 41/04*** | (2006.01) |
| ***H01F 27/24*** | (2006.01) |
| ***H01F 1/153*** | (2006.01) |
| ***H01F 27/29*** | (2006.01) |

(Continued)

(52) U.S. Cl.

CPC ..... *H01F 27/2804* (2013.01); *H01F 1/153* (2013.01); *H01F 17/0013* (2013.01); *H01F 17/04* (2013.01); *H01F 27/24* (2013.01); *H01F 27/292* (2013.01); *H01F 27/324* (2013.01); *H01F 41/042* (2013.01); *H01F 41/046* (2013.01); *H01F 2017/048* (2013.01)

(58) Field of Classification Search

CPC ..... H01F 1/153; H01F 27/2804; H01F 27/24; H01F 27/292; H01F 27/324; H01F 27/323; H01F 27/32; H01F 17/0013; H01F 17/04; H01F 17/0006; H01F 2017/048; H01F 2017/0073; H01F 2017/002; H01F 41/042

USPC ..... 336/200, 223, 233, 192

See application file for complete search history.

(56) References Cited

U.S. PATENT DOCUMENTS 4,075,591 A * 2/1978 Haas ..... H01F 27/2804 336/200

7,570,145 B2 * 8/2009 Yeh ..... H01F 10/131 336/233

(Continued)

FOREIGN PATENT DOCUMENTS

JP 5874199 B2 1/2016

*Primary Examiner* — Mang Tin Bik Lian

(74) *Attorney, Agent, or Firm* — Morgan, Lewis & Bockius LLP

(57) ABSTRACT

A coil component includes a body including a magnetic material, a support member disposed inside the body, and a coil pattern disposed on the support member inside the body. The coil pattern includes a first conductive layer, having a planar spiral shape, and a second conductive layer, having a line width greater than a thickness thereof, while covering the first conductive layer. When viewed from a surface of the body cut in thickness and width directions, a line width of each of outermost and innermost patterns of the first conductive layer is different from a line width of at least one internal pattern disposed between the outermost and innermost patterns.

19 Claims, 8 Drawing Sheets

(51) Int. Cl.

| | |
|---|---|
| ***H01F 17/00*** | (2006.01) |
| ***H01F 27/32*** | (2006.01) |
| ***H01F 17/04*** | (2006.01) |

(56) References Cited

U.S. PATENT DOCUMENTS

| | | | | |
|---|---|---|---|---|
| 2003/0179067 | A1* | 9/2003 | Gamou | H01F 27/2804 336/223 |
| 2008/0157913 | A1* | 7/2008 | Kim | H01F 17/0013 336/200 |
| 2008/0303622 | A1* | 12/2008 | Park | H01F 17/0013 336/200 |
| 2009/0273429 | A1* | 11/2009 | Nakamura | H01F 17/0006 336/200 |
| 2013/0082812 | A1* | 4/2013 | Yoo | H01F 5/003 336/200 |
| 2014/0009254 | A1* | 1/2014 | Ohkubo | H01F 27/2804 336/192 |
| 2014/0034373 | A1* | 2/2014 | Yoshikawa | H01F 5/003 174/260 |
| 2015/0035634 | A1* | 2/2015 | Nakamura | H01F 17/0013 336/170 |
| 2015/0035640 | A1 | 2/2015 | Wang et al. | |
| 2016/0351316 | A1* | 12/2016 | Ohkubo | H01F 17/0006 |

* cited by examiner

COIL COMPONENT AND METHOD FOR MANUFACTURING THE SAME

CROSS-REFERENCE TO RELATED APPLICATION

This application claims the benefit of priority to Korean Patent Application No. 10-2017-0010480, filed on Jan. 23, 2017 with the Korean Intellectual Property Office, the entirety of which is incorporated herein by reference.

BACKGROUND

The present disclosure relates to a coil component, for example, a power inductor.

An inductor is a coil component, and is a representative passive device that may constitute a component in an electronic circuit, along with a resistor and a capacitor, to remove noise therefrom. The inductor may be divided into a thin-film inductor using plating, a multilayer inductor using paste printing, and a winding inductor using a winding coil.

In recent years, with the miniaturization and thinning of electronic devices, such as digital TVs, mobile phones, and laptops, the miniaturization and implementation of high capacity in coil components used in such electronic devices have been required. Therefore, a primary type of power inductor is changing from being a multilayer type power inductor to a thin-film type power inductor and a winding type power inductor, while seeking to reduce the cost of magnetic materials.

In the case of the thin-film inductor, there have been attempts to further reduce the thickness of a chip, depending on changes in the recent set of complexity, multifunctionality, and slimness. As a result, even with the trend for slimness, a need exists for a method for ensuring high degrees of performance and reliability.

SUMMARY

An aspect of the present disclosure may provide a coil component that may ensure high degrees of performance and reliability, while being applied to a compact model.

One solution proposed by the present disclosure is to form a coil pattern through sequential forming of a first conductive layer and a second conductive layer having a planar spiral shape, and to adjust a line width of the first conductive layer, thus reducing process variations or the like in the forming of the second conductive layer.

According to an aspect of the present disclosure, a coil component may include: a body including a magnetic material; a support member disposed inside the body; and a coil pattern disposed on the support member inside the body, in which the coil pattern may include a first conductive layer, having a planar spiral shape, and a second conductive layer, having a line width greater than a thickness thereof, while covering the first conductive layer, and when viewed from a surface of the body cut in thickness and width directions, a line width of each of outermost and innermost patterns of the first conductive layer may be different from a line width of at least one internal pattern disposed between the outermost and innermost patterns.

According to an aspect of the present disclosure, a method for manufacturing a coil component may include: forming a coil pattern on a support member; and forming a body by covering the support member with a magnetic material, in which the forming the coil pattern may include forming a first conductive layer, having a planar spiral shape, and forming a second conductive layer on the support member, the second conductive layer having a thickness greater than a line width thereof, while covering the first conductive layer, and when viewed from a surface of the body cut in thickness and width directions, a line width of each of outermost and innermost patterns of the first conductive layer may be different from a line width of at least one internal pattern disposed between the outermost and innermost patterns.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
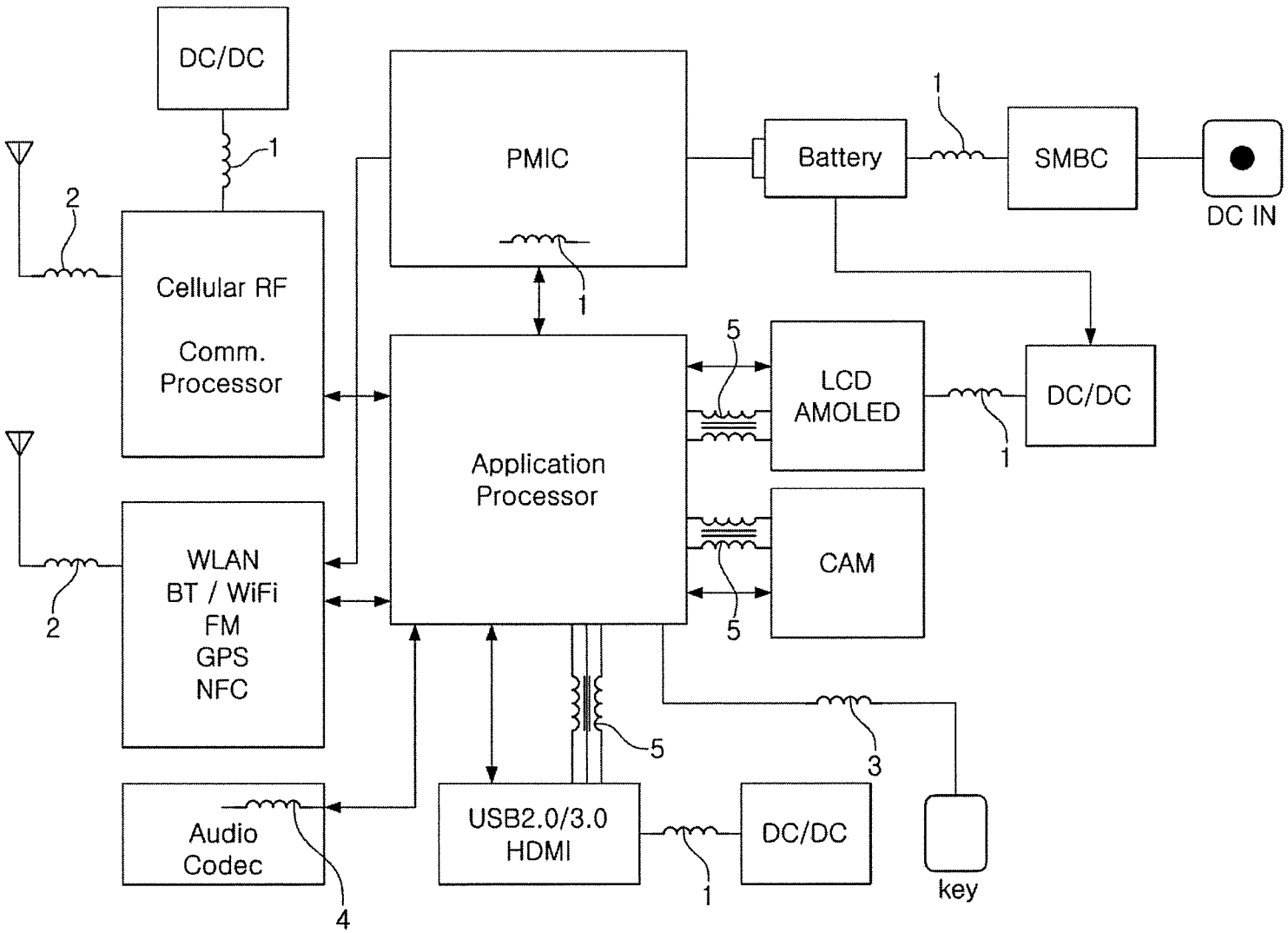
FIG. 1 illustrates a schematic example of a coil component used in an electronic device.

Hereinafter, embodiments of the present disclosure will be described with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element, or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated, listed items.

It will be apparent that, although the terms 'first,' 'second,' 'third,' etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" or the like, may be used herein for ease of description to describe one element's relationship relative to another element(s), as shown in the figures. It will be understood that spatially relative terms are intended to encompass different orientations of the device in use or operation, in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations, depending on a particular directional orientation of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape resulting from manufacturing. The following embodiments may also be constituted alone or as a combination of several or all thereof.

The contents of the present disclosure described below may have a variety of configurations, and only a required configuration is proposed herein, but the present disclosure is not limited thereto.

Electronic Device

FIG. 1 illustrates a schematic example of a coil component used in an electronic device. Referring to FIG. 1, various types of electronic components may be used in the electronic device, such as a direct current/direct current (DC/DC) device, a communications processor module (CPM), a wireless local area network (WLAN) device, a Bluetooth (BT) device, a Wi-Fi device, a frequency modulation (FM) device, a global positioning system (GPS) device, a near field communication (NFC) device, a power management integrated circuit (PMIC), a battery, a switched-mode battery charger (SMBC), a liquid crystal display (LCD), an active-matrix organic light-emitting diode (AMOLED), an audio codec, a universal serial bus (USB) 2.0/3.0 device, a high-definition multimedia interface (HDMI), or a camera or webcam (CAM), using an application processor as a primary part. In this case, various types of coil components may be properly adopted in spaces between these electronic components to remove noise or the like, according to use, such as a power inductor 1, a high frequency (HF) inductor 2, a general bead 3, a high frequency (GHz) bead 4, or a common mode filter 5.

In more detail, the power inductor 1 may be used to store electricity in magnetic field form to maintain an output voltage, thereby stabilizing power. Further, the HF inductor 2 may be used to perform impedance matching to secure a required frequency or to cut off noise and an alternating current (AC) component. Further, the general bead 3 may be used to remove noise of power and signal lines or eliminate a high frequency ripple. Further, the GHz bead 4 may be used to remove high frequency noise of signal lines related to audio and power lines. Further, the common mode filter 5 may be used to pass a current therethrough in a differential mode and remove only common mode noise.

The electronic device may be a typical smartphone, but is not limited thereto. For example, the electronic device may be a personal digital assistant, a digital video camera, a digital still camera, a network system, a computer, a monitor, a television, a video game console, a smart watch, or an automobile. The electronic device may also be various other electronic devices well-known in those of ordinary skill in the art, in addition to the devices described above.

Coil Component

A coil component, according to an exemplary embodiment, will be described hereinafter, and for convenience, a structure of a power inductor is described as an example. However, the coil component, according to the exemplary embodiment, may be applied to other coil components, having various different purposes, as described above.

Meanwhile, a lateral portion used below may define a first direction or a second direction, an upper portion used below may define a third direction, and a lower portion used below may define a direction opposite the third direction, for convenience. Further, a width direction may refer to the first or second direction, and a thickness direction may refer to the third direction.

Further, locating a component on the lateral portion, the upper portion, or the lower portion may be used as including a direct contact between the component and a reference component in a direction and an indirect contact therebetween in the direction. However, this may define a direction for convenience of description, but the scope of the claims is not limited to descriptions of the direction.

FIG. 2 shows a schematic perspective view of an example of a coil component 100.

Figure 2A:
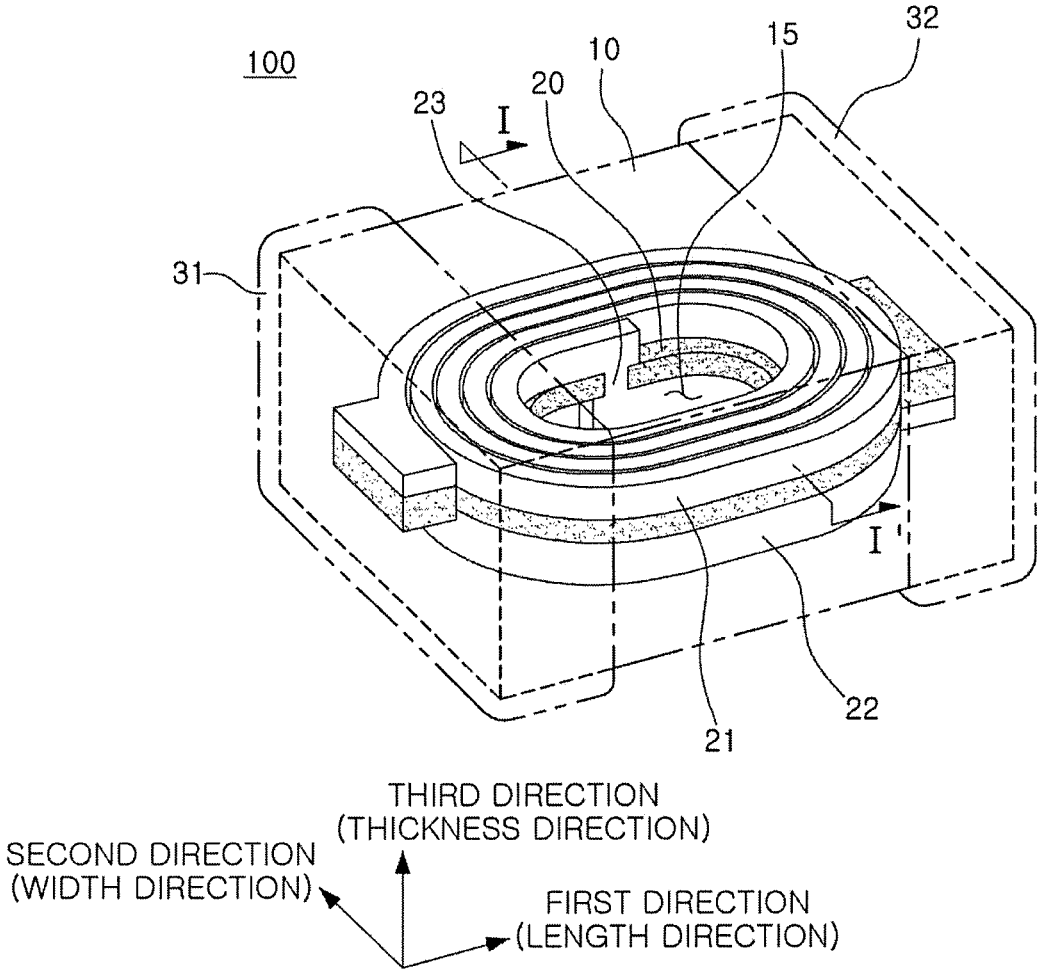
FIG. 2A shows a schematic perspective view of an example of a coil component.
Figure 2B:
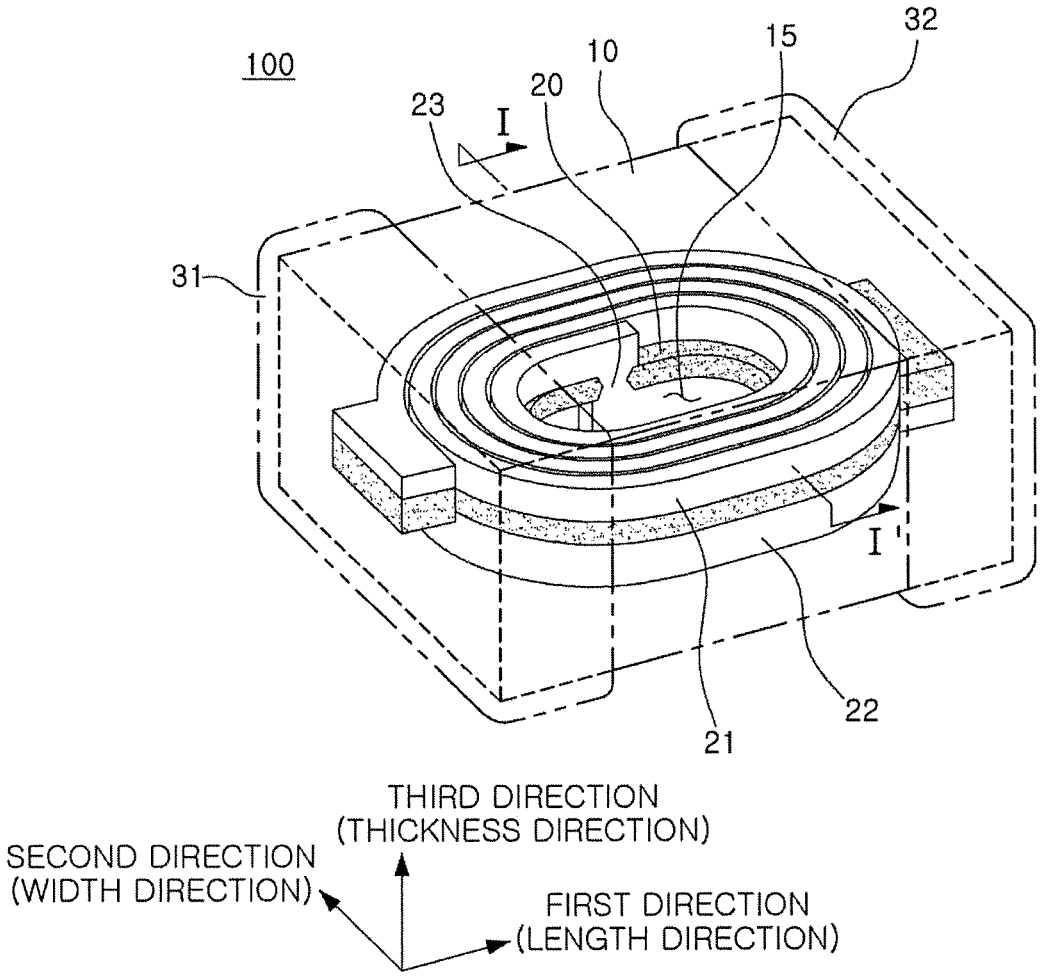
FIG. 2B shows a schematic perspective view of another example of a coil component.
Figure 3:
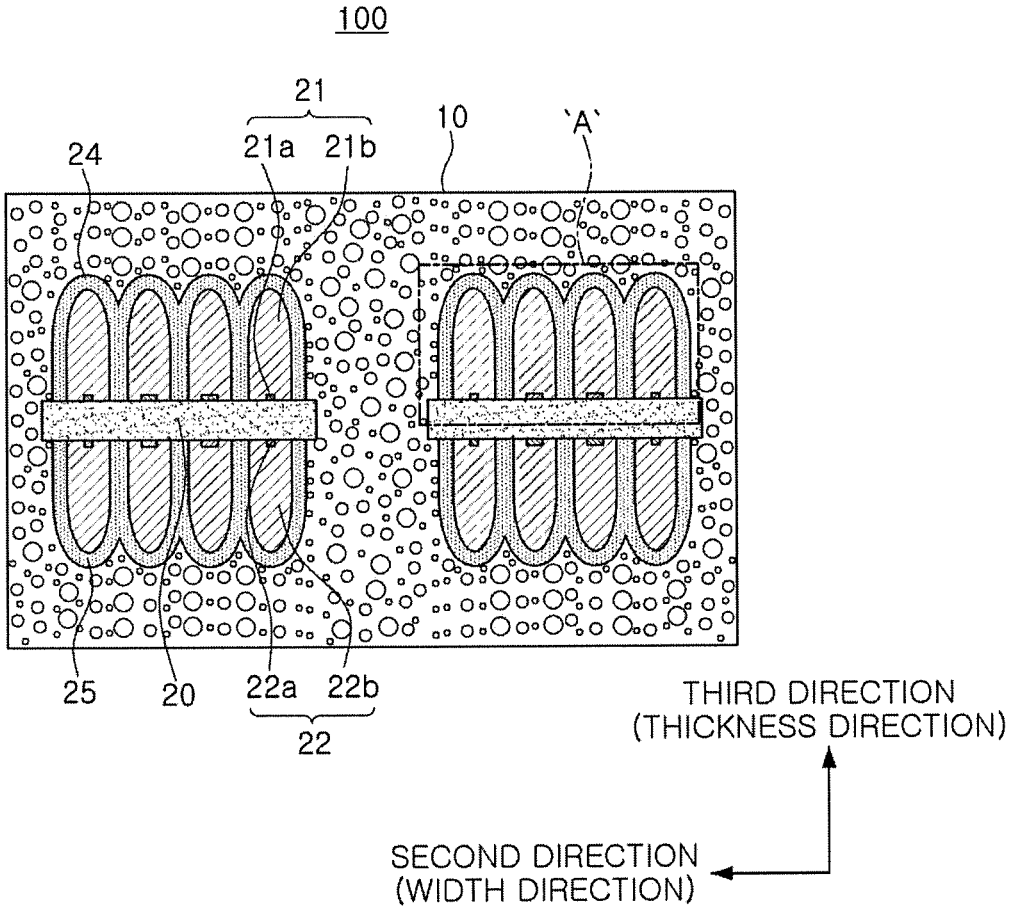
FIG. 3 illustrates a schematic cross-sectional view of the coil component taken along line I-P of FIG. 2.

FIG. 3 illustrates a schematic cross-sectional view of the coil component 100 taken along line I-P of FIG. 2.

Referring to FIGS. 2 and 3, the coil component 100, according to an exemplary embodiment, may include a support member 20 disposed inside a body 10, first and second coil patterns 21 and 22 formed on upper and lower surfaces of the support member 20, respectively, and first and second external electrodes 31 and 32 disposed on the body 10, while being connected to the first and second coil patterns 21 and 22, respectively. The first and second coil patterns 21 and 22 may include first conductive layers 21*a* and 22*a*, having a planar spiral shape, and second conductive layers 21*b* and 22*b*, having a planar spiral shape, while covering the first conductive layers 21*a* and 22*a*, respectively. The respective first conductive layers 21*a* and 22*a* of the first and second coil patterns 21 and 22 may have a line width of each of outermost and innermost patterns different from a line width of at least one internal pattern disposed between the outermost and innermost patterns.

Recently, with the miniaturization of electronic devices, such as a portable device or the like, the miniaturization and thinning of various types of chip components used in electronic devices have been researched. In such a trend, high performance of the coil component may be required, regardless of the miniaturization and thinning thereof. Thus, a need exists to significantly increase an area of the coil within a limited space of the coil component. Here, a reduction in direct current resistance (Rdc) through increasing the coil area may have a great influence on coil efficiency. As a method for increasing the coil area, research into increasing an aspect ratio, a ratio of a height to a line width, of the coil pattern, using plating, has been conducted. When the coil pattern, having a high aspect ratio, is formed using plating, uniformity of plating growth may be reduced, according to an increase of the aspect ratio, and a problem with reliability, such as an occurrence of short circuits between coil patterns, may occur.

Conversely, the coil component 100, according to an exemplary embodiment, may have the first conductive layers 21*a* and 22*a* formed on the support member 20, while having the planar spiral shape, and the second conductive layers 21*b* and 22*b* formed on the support member 20 using the first conductive layers 21*a* and 22*a* as lead lines, while having a high aspect ratio and a planar spiral shape. When viewed from a surface of the body 10 cut in the thickness and width directions (i.e. third and second directions), the line width of each of the outermost and innermost patterns of the first conductive layers 21*a* and 22*a* may be different from the line width of the at least one internal pattern disposed between the outermost and innermost patterns. When forming the second conductive layers 21*b* and 22*b* using plating, uniformity of plating growth may be constant, regardless of an increase of the aspect ratio of the second conductive layers 21*b* and 22*b*, and short circuits may also be significantly reduced. For example, the coil component 100, according to an exemplary embodiment, may allow the line width of each of the first conductive layers 21*a* and 22*a* to be adjusted to reduce plating variations of the second conductive layers 21*b* and 22*b*, having the high aspect ratio, thus significantly increasing Rdc and inductance (Ls) characteristics. In addition, using the first conductive layers 21*a* and 22*a* as the lead lines, the second conductive layers 21*b* and 22*b* may be formed to extend therefrom to make an additional plating process or the like unnecessary during the formation of the second conductive layers 21*b* and 22*b*, thus increasing productivity through streamlining of manufacturing processes.

The components of the coil component 100, according to an exemplary embodiment, will be further detailed hereinafter with reference to the drawings.

The body 10 may form an exterior of the coil component 100. The body 10 may have first and second surfaces opposing each other in the first direction, third and fourth surfaces opposing each other in the second direction, and fifth and sixth surfaces opposing each other in the third direction. The body 10 may be approximately hexahedral, but is not limited thereto. Six corners, at which the first to sixth surfaces meet each other, may be rounded by grinding or the like.

The body 10 may include a magnetic material, exhibiting magnetic characteristics. For example, the body 10 may be formed by mixing ferritic or magnetic metal powder particles in a resin. The ferrite may include a material, such as Mn—Zn-based ferrite, Ni—Zn-based ferrite, Ni—Zn—Cu-based ferrite, Mn—Mg-based ferrite, Ba-based ferrite, Li-based ferrite, or the like. The magnetic metal powder particles may include at least one selected from the group consisting of iron (Fe), silicon (Si), chromium (Cr), aluminum (Al), and nickel (Ni). For example, the magnetic metal powder particles may be a Fe—Si—B—Cr-based amorphous metal, but are not necessarily limited thereto.

The magnetic material of the body 10 may be a magnetic material-resin composite, including the magnetic metal powder particles and the insulating resin. The magnetic metal powder particles may include iron (Fe), chromium (Cr), or silicon (Si) as a main ingredient. For example, the magnetic metal powder particles may include iron-nickel (FeNi), iron (Fe), iron-chromium-silicon (FeCrSi), or the like, but are not limited thereto. The insulating resin may include an epoxy, a polyimide, and/or a liquid crystal polymer (LCP), or the like, but is not limited thereto. The magnetic metal powder particles may have at least two average particle sizes. Alternatively, the magnetic metal powder particles may have at least three average particle sizes. In this case, the magnetic metal powder particles, having different average particle sizes, may fill the magnetic material-resin composite, such that a packing factor of the magnetic material-resin composite may be increased. As a result, an inductance of the coil component 100 may be increased.

A material or type of the support member 20 is not particularly limited as long as the support member 20 may support the coil patterns 21 and 22. For example, the support member 20 may be a copper clad laminate (CCL), a polypropylene glycol (PPG) substrate, a ferrite substrate, a soft magnetic metal substrate, or the like. In addition, the support member 20 may be an insulating substrate formed of an insulating resin. For example, a thermosetting resin, such as an epoxy resin, a thermoplastic resin, such as a polyimide resin, a resin, having a reinforcing material, such as glass fiber or an inorganic filler impregnated in the thermosetting resin and the thermoplastic resin, such as a prepreg, an Ajinomoto build-up film (ABF), or the like, may be used as the insulating resin. An insulating substrate, including glass fiber and an epoxy resin, may be used in terms of maintenance of rigidity, but is not limited thereto. A thickness T of the support member 20 may be 80 μm or less, preferably, 60 μm or less, more preferably, 40 μm or less, but is not limited thereto.

The coil patterns 21 and 22 may enable the coil component 100 to perform various functions using characteristics exhibited by the coil. For example, the coil component 100 may be a power inductor. In this case, the coil patterns 21 and 22 may store electricity in a magnetic field to maintain an output voltage, thus stabilizing power. The coil patterns 21 and 22 may include the first coil pattern 21 and the second coil pattern 22 disposed on the upper surface and the lower surface of the support member 20, respectively, and the first and second coil patterns 21 and 22 may be electrically connected by a via 23 (FIG. 2), passing through the support member 20.

The coil pattern 21 may include the first conductive layer 21*a* and the second conductive layer 21*b*, and the coil pattern 22 may include the first conductive layer 22*a* and the second conductive layer 22*b*, respectively. The first conductive layers 21*a* and 22*a* may be disposed on the support member 20, and may have a planar spiral shape. The second conductive layers 21*b* and 22*b* may be disposed on the support member 20 to cover the first conductive layers 21*a* and 22*a*, and may also have a planar spiral shape. The first conductive layers 21*a* and 22*a* and the second conductive layers 21*b* and 22*b* may both be formed using plating, and may include a conductive material, such as copper (Cu), aluminum (Al), silver (Ag), tin (Sn), gold (Au), nickel (Ni), lead (Pb), or alloys thereof, respectively. Each of the first conductive layers 21*a* and 22*a* may have an outermost pattern and an innermost pattern each having a line width different from a line width of an internal pattern disposed therebetween, thus reducing process variations that may occur in the process of forming the second conductive layers 21*b* and 22*b*.

The via 23 (FIG. 2) may pass through the support member 20, and may electrically connect the first and second coil patterns 21 and 22. Thus, the first and second coil patterns 21 and 22 may form a single coil by being electrically connected. The via 23 may include a conductive material, such as copper (Cu), aluminum (Al), silver (Ag), tin (Sn), gold (Au), nickel (Ni), lead (Pb), or alloys thereof. The via 23 may also have a cross section having an hourglass shape (FIG. 2B) or a cylindrical shape (FIG. 2A).

Insulating films 24 and 25 may protect the coil patterns 21 and 22. The insulating films 24 and 25 may also cover the coil patterns 21 and 22, respectively. Any material, including an insulating material, may be used as a material of the insulating films 24 and 25. For example, the materials of the insulating films 24 and 25 may include an insulating material used in common insulating coating, for example, a thermosetting resin, such as an epoxy resin or a polyimide resin, but are not limited thereto.

A through hole 15 may be formed in a central portion of the support member 20, and may be filled with a magnetic material to form a magnetic core. For example, central portions of the first and second coil patterns 21 and 22 may be connected without interference therewith by the support member 20 to form the magnetic core filled with the magnetic material. In this case, inductance characteristics may be further increased.

When the coil component 100 is mounted in the electronic device or the like, the first and second external electrodes 31 and 32 (FIG. 1) may electrically connect the coil patterns 21 and 22 within the coil component 100 to the electronic device. The first and second external electrodes 31 and 32 may be connected to lead electrodes of the first and second coil patterns 21 and 22, respectively. The first and second external electrodes 31 and 32 may include a conductive material. For example, each of the first and second external electrodes 31 and 32 may include a conductive resin layer, and a plating layer formed on the conductive resin layer. The conductive resin layer may include one or more conductive metals selected from the group consisting of copper (Cu), nickel (Ni), and silver (Ag), and a thermosetting resin. The plating layer may include at least one selected from the group consisting of nickel (Ni), copper (Cu), and tin (Sn). For example, a nickel (Ni) layer and a tin (Sn) layer may be sequentially formed in the plating layer. However, the present disclosure is not limited thereto. For example, the order of the Ni and Sn layers may be reversed.

Figure 4:
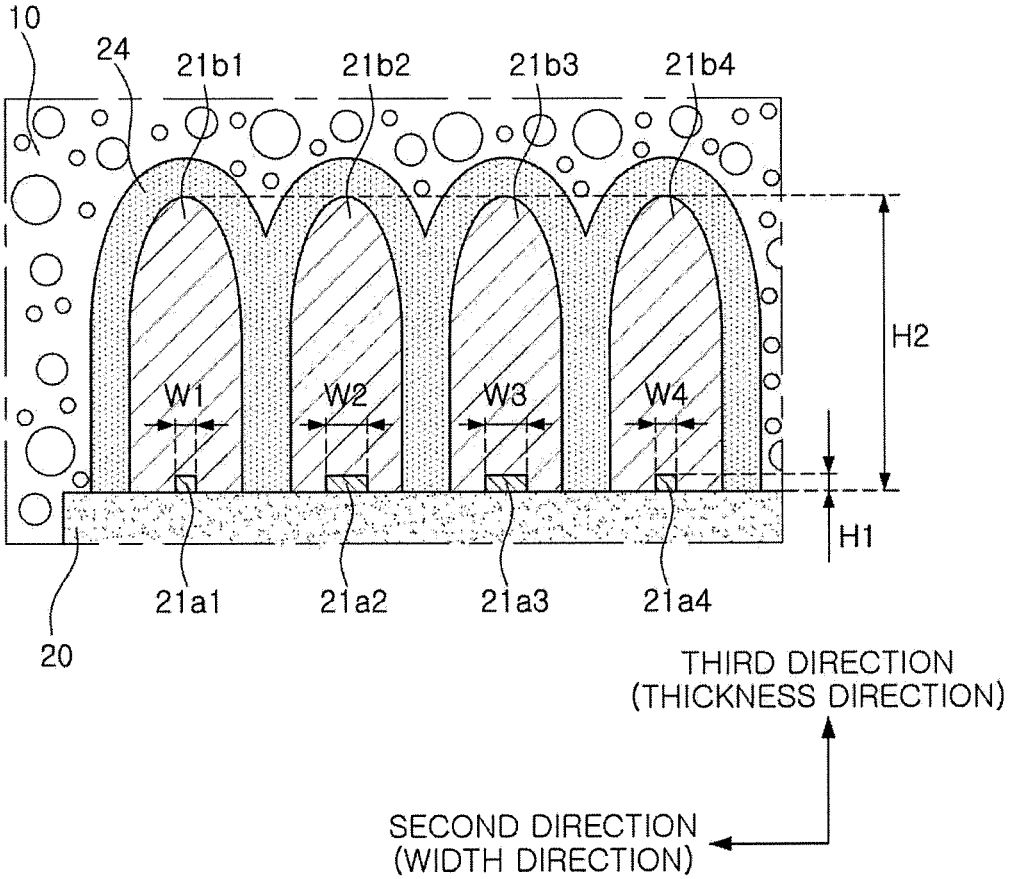
FIG. 4 illustrates a schematic enlarged view of region A of the coil component of FIG. 3.

FIG. 4 illustrates a schematic enlarged view of region A of the coil component 100 of FIG. 3.

Referring to FIG. 4, when viewed from the surface of the body 10 cut in the thickness and width directions (i.e. third and second directions), a line width W1 of an outermost pattern 21*a*1 and a line width W4 of an innermost pattern 21*a*4, of the first conductive layer 21*a* of the first coil pattern 21 may be less than line widths W2 and W3 of internal patterns 21*a*2 and 21*a*3 disposed between the outermost pattern 21*a*1 and the innermost pattern 21*a*4. When the line width W1 of the outermost pattern 21*a*1 and the line width W4 of the innermost pattern 21*a*4 are the same as or wider than the line width W2 of the internal patterns 21*a*2 and the line width W3 of the internal patterns 21*a*3, the outermost pattern 21*a*1 and the innermost pattern 21*a*4 may be excessively grown to adversely affect process variations. When process variations occur, a cross section of the coil may be nonuniform, it may be difficult to reduce direct current resistance (Rdc), and a cover layer of the body 10, covering the coil, may be thin, thus having a bad influence on inductance (Ls). In contrast, when the line width W1 of the outermost pattern 21*a*1 and the line width W4 of the innermost pattern 21*a*4 are narrower than the line width W2 of the internal patterns 21*a*2 and the line width W3 of the internal patterns 21*a*3, process variations may be easily controlled. Although not illustrated in the drawings, this configuration may be the same as in the second coil pattern 22.

Referring to the drawings, when viewed from the surface of the body 10 cut in the thickness and width directions (i.e. third and second directions), the second conductive layer 21*b* of the first coil pattern 21 having patterns 21*b*1, 21*b*2, 21*b*3, and 21*b*4 may have a height H2 greater than a height H1 of the first conductive layer 21*a*. For example, the second conductive layer 21*b* may have a height greater than a line width thereof, and may have a high aspect ratio, thus providing a sufficient coil area. In contrast, the first conductive layer 21*a* may have a low aspect ratio in terms of plating stability, and for example, the internal patterns 21*a*2 and 21*a*3 of the first conductive layer 21*a* of the first coil pattern 21 may have a height less than a line width of the internal patterns 21*a*2 and 21*a*3. In this respect, a distance between an upper surface of the first conductive layer 21*a* and an upper surface of the second conductive layer 21*b* may be greater than a distance between a side surface of the first conductive layer 21*a* and a side surface of the second conductive layer 21*b*. Although not illustrated in the drawings, this configuration may be the same as in the second coil pattern 22.

Figure 5:
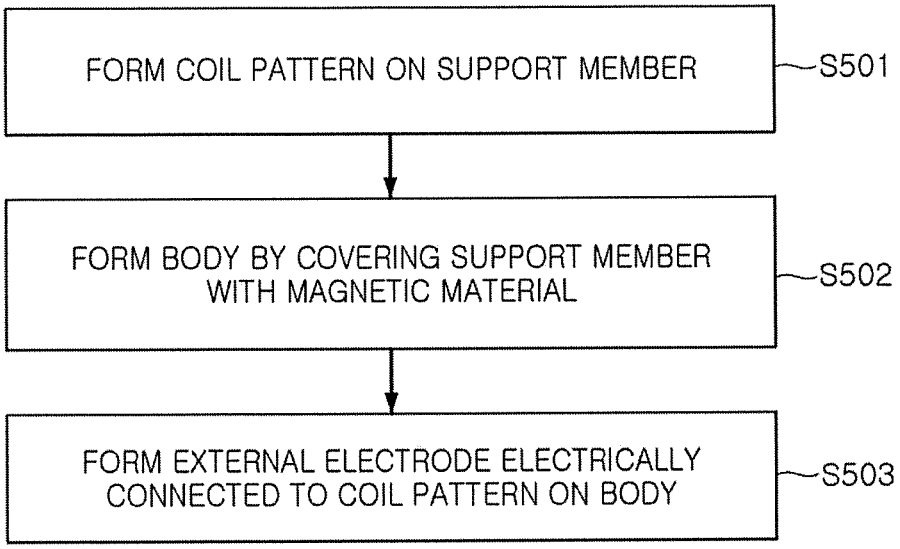
FIG. 5 shows a schematic flowchart illustrating an example of a process of manufacturing a coil component.

FIG. 5 shows a schematic flowchart illustrating an example of a process of manufacturing a coil component.

Figure 6:
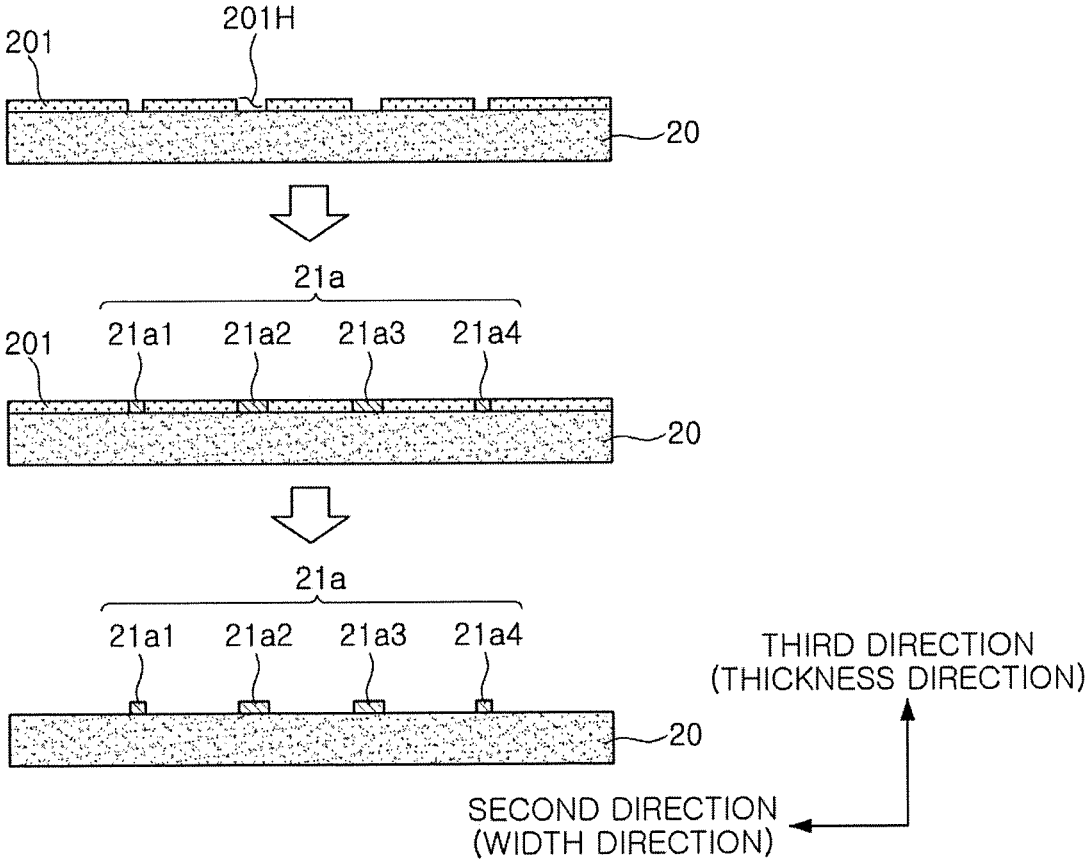
FIG. 6 shows schematic views of an example of a process of manufacturing a coil component of an embodiment of the present disclosure.

FIG. 6 shows schematic views of an example of a process of manufacturing a first conductive layer of a coil pattern.

Figure 7:
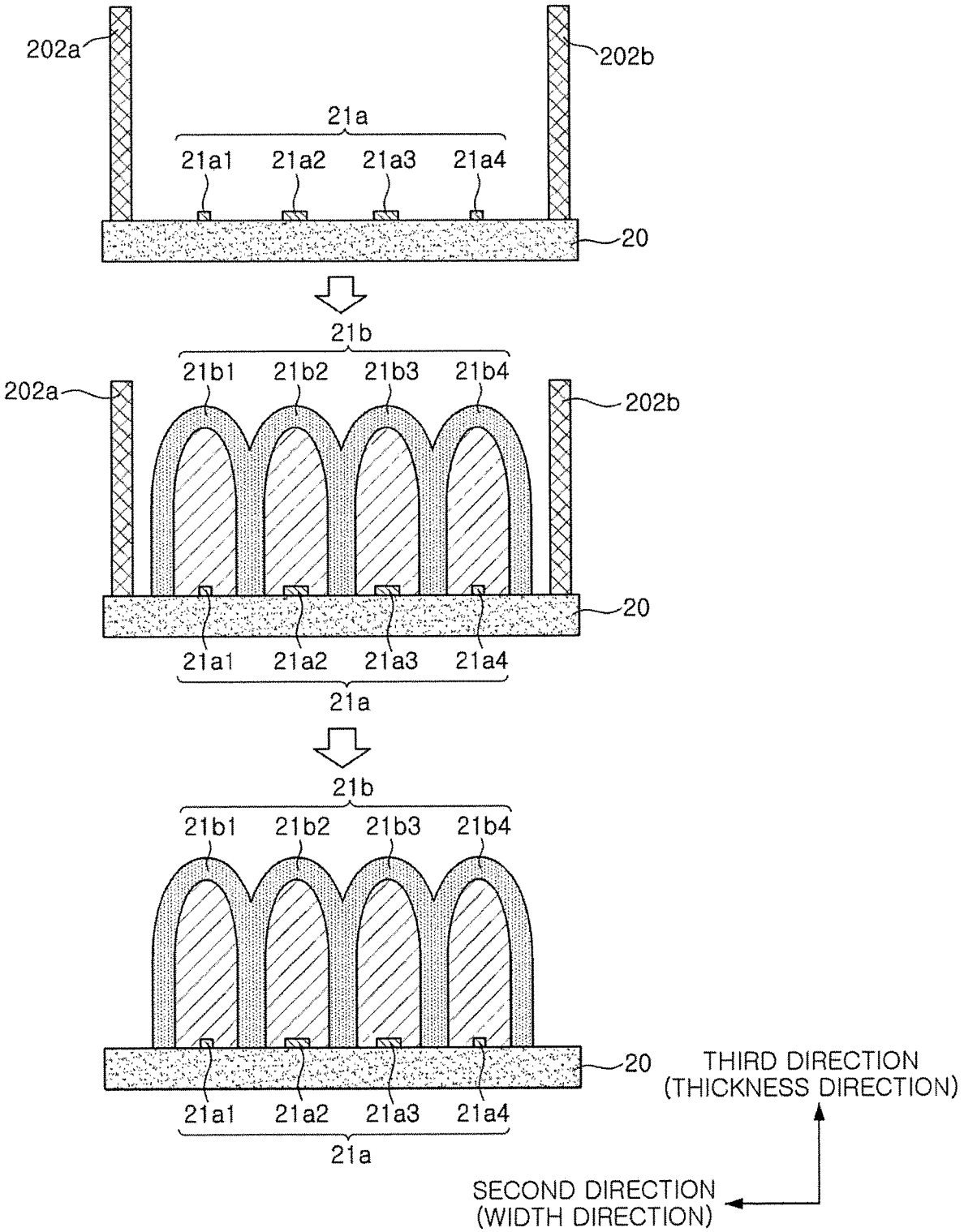
FIG. 7 shows schematic views of an example of a process of manufacturing a first conductive layer of a coil pattern.

FIG. 7 shows schematic views of an example of a process of manufacturing a first conductive layer of a coil pattern.

Referring to FIGS. 5, 6 and 7, a method for manufacturing the coil component 100, according to an exemplary embodiment, may include a step S501, i.e. forming the coil patterns 21 and 22 on the support member 20; a step S502, i.e. forming the body 10 by covering the support member 20 with the magnetic material; and a step S503, i.e. forming the first and second external electrodes 31 and 32 electrically connected to the coil patterns 21 and 22 on the body 10.

First, a resist 201, having an opening portion 201H having a planar spiral shape, for forming the first conductive layer 21*a*, may be formed on the support member 20. Subsequently, the first conductive layer 21*a* may be formed by filling the opening portion 201H with plating. The resist 201 may then be removed from the support member 20. The first conductive layer 21*a* may be formed through a series of processes. The resist 201 may be a common photosensitive resist film.

Subsequently, dams 202*a* and 202*b* may be formed on lateral portions of the outermost and innermost patterns 21*a*1 and 21*a*4 of the first conductive layer 21*a* on the support member 20. The second conductive layer 21*b* may then be formed by applying plating to the support member 20, using the first conductive layer 21*a* as the lead line, such that the plating may be grown greatly in the thickness direction (i.e. third direction), as compared to the width direction (i.e. second direction). In detail, the second conductive layer 21*b* may be formed of an anisotropic plating layer that may be grown in only the thickness direction, while being restricted in growth in the width direction by adjusting current density, plating solution concentration, or a plating rate at the time of electroplating. Thus, the second conductive layer 21*b* may have an aspect ratio of 1.2 or higher. Insulating layers are then formed to separate the individual patterns of the second conductive layer 21*b*1, 21*b*2, 21*b*3, and 21*b*4. Subsequently, the dams 202*a* and 202*b* may be removed from the support member 20. The second conductive layer 21*b* may be formed through a series of processes. As a result, the first coil pattern 21 may be formed. Likewise, the dams 202*a* and 202*b* may be a known photosensitive resist film, which may prevent short circuits due to the plating.

Although not illustrated in the drawings, forming the second coil pattern 22 may be substantially the same as forming the first coil pattern 21, and the first and second coil patterns 21 and 22 may be formed simultaneously.

When forming the coil patterns 21 and 22, the via 23 may be formed by performing a plating process after forming a via hole, passing through the support member 20. Further, after the forming of the coil patterns 21 and 22, the insulating films 24 and 25, covering the coil patterns 21 and 22, may be formed. The insulating films 24 and 25 may be formed using a known method, such as a screen printing process, a process photoresist (PR) exposure and development process, or a spraying process.

Subsequently, magnetic sheets may be stacked on and below the support member 20 on which the coil patterns 21 and 22 are formed, and may be compressed and cured to form the body 10. The magnetic sheets may be manufactured in a sheet shape by organic materials, such as mixing magnetic metal particles, a binder resin, and a solvent, with each other to prepare slurry and applying and then drying the slurry at a thickness of several ten micrometers on a carrier film by a doctor blade method.

The through hole 15 may be formed by removing the central portion of the support member 20 using a mechanical drilling, laser drilling, sandblasting, or punching process, and the through hole 15 may be filled with the magnetic material in the process of compressing and curing the magnetic sheet.

Subsequently, the first and second external electrodes 31 and 32, covering at least a first surface and a second surface of the body 10, respectively, may be formed to be connected to the lead electrodes of the first and second coil patterns 21 and 22 respectively led to the first and second surfaces of the body 10. The first and second external electrodes 31 and 32 may be formed of paste including a metal having improved electroconductive properties. For example, the first and second external electrodes 31 and 32 may be formed using a method for printing a conductive paste including nickel (Ni), copper (Cu), tin (Sn), silver (Ag), or alloys thereof. In addition, the plating layers may be further formed after printing the conductive paste, and may include at least one selected from the group consisting of nickel (Ni), copper (Cu), and tin (Sn). For example, a nickel (Ni) layer and a tin (Sn) layer may be sequentially formed in each of the plating layers.

Figure 8:
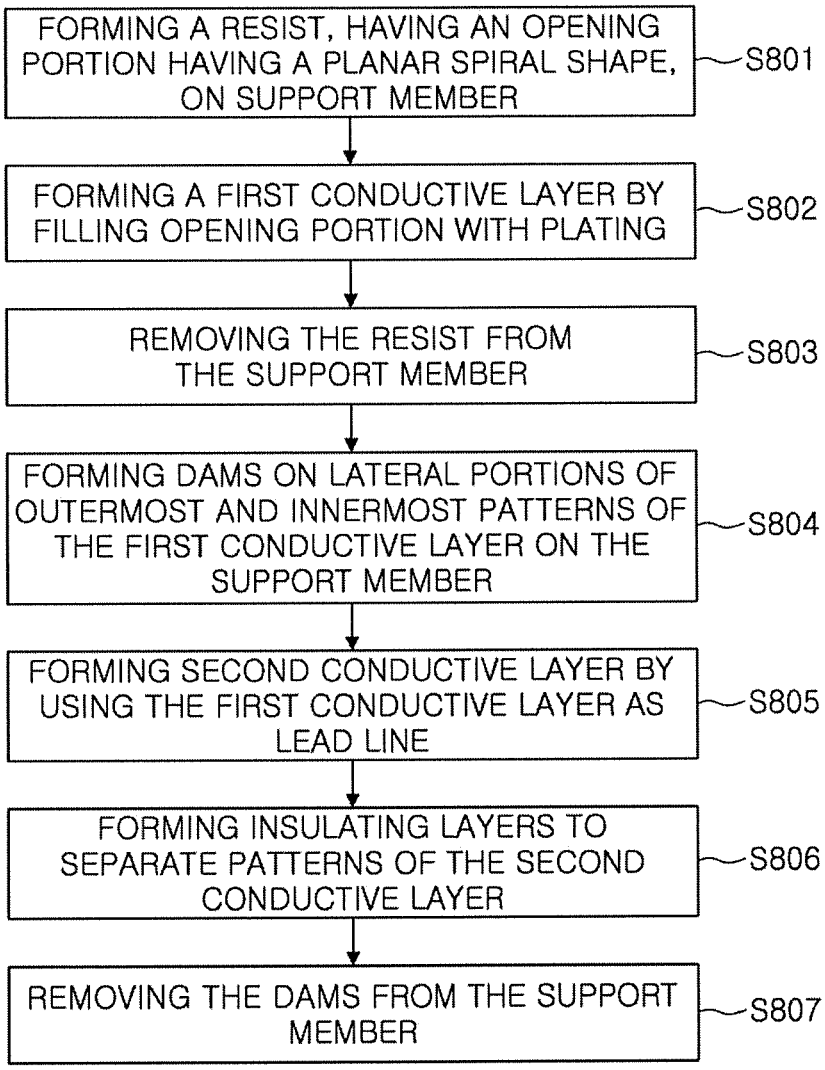
FIG. 8 shows schematic views of an example of a process of manufacturing a second conductive layer of a coil pattern.

FIG. 8 shows schematic views of an example of a process of manufacturing a second conductive layer of a coil pattern. In step S801, a resist 201, having an opening portion 201H having a planar spiral shape, for forming the first conductive layer 21*a*, may be formed on the support member 20. Subsequently, in step S802, the first conductive layer 21*a* may be formed by filling the opening portion 201H with plating. Then, in step S803, the resist 201 may then be removed from the support member 20. The first conductive layer 21*a* may be formed through a series of processes. The resist 201 may be a common photosensitive resist film.

Subsequently, in step S804, dams 202*a* and 202*b* may be formed on lateral portions of the outermost and innermost patterns 21*a*1 and 21*a*4 of the first conductive layer 21*a* on the support member 20. In step S805, the second conductive layer 21*b* may then be formed by applying plating to the support member 20, using the first conductive layer 21*a* as the lead line, such that the plating may be grown greatly in the thickness direction (i.e. third direction), as compared to the width direction (i.e. second direction). In detail, the second conductive layer 21*b* may be formed of an anisotropic plating layer that may be grown in only the thickness direction, while being restricted in growth in the width direction by adjusting current density, plating solution concentration, or a plating rate at the time of electroplating. Thus, the second conductive layer 21*b* may have an aspect ratio of 1.2 or higher. In step S806, insulating layers are then formed to separate the individual patterns of the second conductive layer 21*b*1, 21*b*2, 21*b*3, and 21*b*4. Subsequently, in step S807, the dams 202*a* and 202*b* may be removed from the support member 20. The second conductive layer 21*b* may be formed through a series of processes. As a result, the first coil pattern 21 may be formed. Likewise, the dams 202*a* and 202*b* may be a known photosensitive resist film, which may prevent short circuits due to the plating.

As set forth above, according to the exemplary embodiments, there may be provided a coil component that may ensure high degrees of performance and reliability, while being applied to a compact model, and a method for manufacturing the same.

While exemplary embodiments have been shown and described above, it will be apparent to those skilled in the art that modifications and variations could be made without departing from the scope of the present disclosure, as defined by the appended claims.

What is claimed is:

1. A coil component, comprising:

a body including a magnetic material;

a support member disposed inside the body; and a coil pattern disposed on the support member inside the body, wherein the coil pattern includes a first conductive layer, having a planar spiral shape, and a second conductive layer, having a line width lesser than a thickness thereof, while covering the first conductive layer, and wherein, when viewed from a surface of the body cut in thickness and width directions, a line width of an innermost and outermost pattern of the first conductive layer is narrower than a line width of at least two internal patterns of the first conductive layer disposed between the outermost and innermost patterns.

2. The coil component of claim 1, wherein at least one internal pattern of the first conductive layer has a thickness less than a line width of the at least one internal pattern.

3. The coil component of claim 1, wherein the second conductive layer covers an upper surface and a side surface of the first conductive layer.

4. The coil component of claim 3, wherein, when viewed from the surface of the body cut in the thickness and width directions, a distance between the upper surface of the first conductive layer and an upper surface of the second conductive layer is greater than a distance between the side surface of the first conductive layer and a side surface of the second conductive layer.

5. The coil component of claim 1, wherein the coil pattern includes a first coil pattern and a second coil pattern disposed on an upper surface and a lower surface of the support member, respectively, and the first and second coil patterns include the first and second conductive layers, respectively.

6. The coil component of claim 5, wherein the first and second coil patterns are connected by a via passing through the support member.

7. The coil component of claim 1, further comprising an insulating film covering the second conductive layer.

8. The coil component of claim 6, wherein the via has a cylindrical shape.

9. The coil component of claim 6, wherein the via has a hourglass shape.

10. The coil component of claim 1, wherein the magnetic material includes magnetic metal powder particles and an insulating resin.

11. The coil component of claim 1, further comprising a through hole in a central portion of the support member, wherein the through hole includes the magnetic material therein.

12. The coil component of claim 1, further comprising an external electrode disposed on the body and electrically connected to the coil pattern.

13. The coil component of claim 1, wherein the second conductive layer has an aspect ratio of 1.2 or higher.

14. A method for manufacturing a coil component, the method comprising:

forming a coil pattern on a support member; and forming a body by covering the support member with a magnetic material, wherein the forming a coil pattern includes forming a first conductive layer, having a planar spiral shape, on the support member, and forming a second conductive layer on the support member, the second conductive layer having a thickness greater than a line width thereof, while covering the first conductive layer, and wherein, when viewed from a surface of the body cut in thickness and width directions, a line width of an innermost and outermost pattern of the first conductive layer is narrower than a line width of at least two internal patterns of the first conductive layer disposed between the outermost and innermost patterns.

15. The method of claim 14, wherein, when viewed from the surface of the body cut in the thickness and width directions, the line width of the outermost pattern of the first conductive layer is narrower than the line width of at least one internal pattern of the first conductive layer disposed between the outermost and innermost patterns.

16. The method of claim 14, wherein the forming a first conductive layer includes:

forming a resist, having an opening portion having a planar spiral shape, on the support member, forming the first conductive layer by filling the opening portion with plating, and removing the resist from the support member.

17. The method of claim 16, wherein the forming a second conductive layer includes forming dams on lateral portions of the outermost and innermost patterns of the first conductive layer, forming the second conductive layer on the support member by applying plating to the first conductive layer, such that the plating grows in the thickness direction, as compared to the width direction, using the first conductive layer as a lead line, and removing the dams from the support member.

18. A coil component, comprising:

a body including a magnetic material;

a support member disposed inside the body; and a coil pattern disposed on the support member inside the body and connected to an external electrode, wherein the coil pattern includes a first conductive layer, having a planar spiral shape, and a second conductive layer, having a line width lesser than a thickness thereof, while covering the first conductive layer, and wherein, when viewed from a surface of the body cut in thickness and width directions, a line width of each of outermost and innermost patterns of the first conductive layer is narrower than a line width of at least two internal patterns of the first conductive layer disposed between the outermost and innermost patterns.

19. The coil component of claim 18, wherein at least one internal pattern of the first conductive layer has a thickness less than a line width of the at least one internal pattern.

* * * * *